US008687032B2

(12) United States Patent
Bouverie et al.

(10) Patent No.: US 8,687,032 B2
(45) Date of Patent: Apr. 1, 2014

(54) PRINTING RIBBON SECURITY APPARATUS AND METHOD

(75) Inventors: William M. Bouverie, Windermere, FL (US); Mark Allen Hitz, Rock Hill, SC (US); Marjorie Hitz, legal representative, Rock Hill, SC (US); Dwayne Steven Tobin, Longwood, FL (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 13/490,072

(22) Filed: Jun. 6, 2012

(65) Prior Publication Data

US 2012/0306986 A1 Dec. 6, 2012

Related U.S. Application Data

(60) Provisional application No. 61/493,598, filed on Jun. 6, 2011.

(51) Int. Cl.
*B41J 2/325* (2006.01)

(52) U.S. Cl.
USPC ..... 347/215

(58) Field of Classification Search
USPC ..... 347/171–176, 215, 217; 400/120.01–120.04
See application file for complete search history.

(56) References Cited

U.S. PATENT DOCUMENTS

| | | | |
|---|---|---|---|
| 4,143,977 | A | 3/1979 | Kurihara et al. |
| 4,177,731 | A | 12/1979 | Kleist et al. |
| 4,788,558 | A | 11/1988 | Caldwell et al. |
| 4,788,559 | A | 11/1988 | Ende |
| 4,872,659 | A | 10/1989 | Kato et al. |
| 4,924,240 | A | 5/1990 | Herbert et al. |
| 4,991,846 | A | 2/1991 | Sondej |
| 5,028,155 | A | 7/1991 | Sugiura et al. |
| 5,087,137 | A | 2/1992 | Burnard et al. |
| 5,206,662 | A | 4/1993 | Fox et al. |
| 5,326,182 | A | 7/1994 | Hagstrom |
| 5,397,192 | A | 3/1995 | Khormaee |
| 5,468,076 | A | 11/1995 | Hirano et al. |
| 5,490,638 | A | 2/1996 | Driftmyer et al. |

(Continued)

FOREIGN PATENT DOCUMENTS

| | | |
|---|---|---|
| JP | 04552558 B2 | 9/2010 |

OTHER PUBLICATIONS

Written Opinion of the International Searching Authority, PCT/US2012/036297, Jul. 17, 2012.

(Continued)

*Primary Examiner* — Kristal Feggins
(74) *Attorney, Agent, or Firm* — Carter, DeLuca, Farrell & Schmidt, LLP

(57) ABSTRACT

An apparatus and method of securing and maintaining the integrity of desired information on a ribbon and media subsequent to a printing operation is provided. The apparatus and method includes a thermal transfer printer having a print station and a printhead operable for performing a printing operation. The printhead is capable of performing an initial print operation and then being raised from the media, thereby allowing the used ribbon to be rewound a predetermined distance about a supply spindle. Thereafter, a second print operation is performed on the space previously printed upon using characters, designs or block-out patterns and the used ribbon is then wound onto a take-up spindle. In exemplary embodiments, the used ribbon can also be reprinted with a waste media several times thus further obscuring the image on the used ribbon.

20 Claims, 5 Drawing Sheets

(56) References Cited

U.S. PATENT DOCUMENTS

| | | | |
|---|---|---|---|
| 5,564,841 | A | 10/1996 | Austin et al. |
| 5,600,350 | A | 2/1997 | Cobbs et al. |
| 5,650,730 | A | 7/1997 | Herbst, Jr. |
| 5,684,516 | A | 11/1997 | Cseledy et al. |
| 5,790,162 | A | 8/1998 | Adams et al. |
| 5,820,280 | A | 10/1998 | Fox |
| 5,836,704 | A | 11/1998 | Lau et al. |
| 5,870,114 | A | 2/1999 | Numata et al. |
| 5,872,585 | A | 2/1999 | Donato et al. |
| 5,874,980 | A | 2/1999 | West |
| 5,909,233 | A | 6/1999 | Hamman et al. |
| 5,927,875 | A | 7/1999 | Lau et al. |
| 5,978,004 | A | 11/1999 | Ehrhardt |
| 5,995,128 | A | 11/1999 | Adams et al. |
| 6,014,229 | A | 1/2000 | Yun |
| 6,020,906 | A | 2/2000 | Adams et al. |
| 6,034,708 | A | 3/2000 | Adams et al. |
| 6,057,870 | A | 5/2000 | Monnier et al. |
| 6,070,048 | A | 5/2000 | Nonaka et al. |
| 6,082,914 | A | 7/2000 | Barrus et al. |
| 6,095,704 | A | 8/2000 | Jaeger et al. |
| 6,099,178 | A | 8/2000 | Spurr et al. |
| 6,129,463 | A | 10/2000 | Lau et al. |
| 6,201,255 | B1 | 3/2001 | Torchalski et al. |
| 6,283,024 | B1 | 9/2001 | George |
| 6,289,730 | B1 | 9/2001 | Elgee |
| 6,302,604 | B1 | 10/2001 | Bryant et al. |
| 6,389,241 | B1 | 5/2002 | Cernusak et al. |
| 6,396,070 | B1 | 5/2002 | Christensen et al. |
| 6,520,614 | B2 | 2/2003 | Kaneko |
| 6,616,362 | B2 | 9/2003 | Bouverie et al. |
| 6,825,864 | B2 | 11/2004 | Botten et al. |
| 6,840,689 | B2 | 1/2005 | Barrus et al. |
| 6,846,121 | B2 | 1/2005 | Bouverie et al. |
| 6,857,714 | B2 | 2/2005 | Hohberger et al. |
| 6,900,449 | B2 | 5/2005 | Bolash et al. |
| 6,942,403 | B2 | 9/2005 | Hohberger et al. |
| 7,042,478 | B2 | 5/2006 | Bouverie et al. |
| 7,071,961 | B2 | 7/2006 | Ullenius et al. |
| 7,079,168 | B2 | 7/2006 | Ullenius et al. |
| 7,150,572 | B2 | 12/2006 | McNestry et al. |
| 7,162,460 | B2 | 1/2007 | Cleckler et al. |
| 7,205,561 | B2 | 4/2007 | Chelvayohan et al. |
| 7,255,343 | B2 | 8/2007 | So |
| 7,375,832 | B2 | 5/2008 | Bouverie et al. |
| 7,456,995 | B2 | 11/2008 | Stephens |
| 7,502,042 | B2 | 3/2009 | Hitz et al. |
| 7,537,404 | B2 | 5/2009 | Bouverie et al. |
| 7,600,684 | B2 | 10/2009 | Tobin et al. |
| 7,667,874 | B2 | 2/2010 | MacDonald et al. |
| 7,699,550 | B2 | 4/2010 | Bouverie et al. |
| 7,824,116 | B2 | 11/2010 | Lyman |
| 7,845,632 | B2 | 12/2010 | Windsor et al. |
| 7,857,414 | B2 | 12/2010 | Eun et al. |
| 7,876,223 | B2 | 1/2011 | Yamaguchi et al. |
| 7,891,892 | B2 | 2/2011 | Chiu |
| 7,907,159 | B2 | 3/2011 | Matsuo et al. |
| 7,934,881 | B2 | 5/2011 | Lodwig et al. |
| 7,938,501 | B2 | 5/2011 | Takamiya et al. |
| 8,142,087 | B2 | 3/2012 | Kugimachi |
| 2001/0008612 | A1 | 7/2001 | Liljestrand et al. |
| 2003/0081024 | A1 | 5/2003 | Vives et al. |
| 2003/0141655 | A1 | 7/2003 | Bryer |
| 2004/0008365 | A1 | 1/2004 | Hobbs |
| 2004/0114024 | A1 | 6/2004 | Bouverie et al. |
| 2004/0165927 | A1 | 8/2004 | Fisher et al. |
| 2005/0002715 | A1 | 1/2005 | Fries et al. |
| 2005/0189693 | A1 | 9/2005 | Ko |
| 2005/0190368 | A1 | 9/2005 | Ehrhardt, Jr. et al. |
| 2005/0204940 | A1 | 9/2005 | Elliott et al. |
| 2006/0007295 | A1 | 1/2006 | Ueda |
| 2006/0045601 | A1 | 3/2006 | Endo |
| 2006/0055721 | A1 | 3/2006 | Burdette et al. |
| 2006/0157911 | A1 | 7/2006 | Learmonth et al. |
| 2006/0159504 | A1 | 7/2006 | Blanchard, Jr. et al. |
| 2006/0180737 | A1 | 8/2006 | Consiglio |
| 2007/0022233 | A1 | 1/2007 | Bridges et al. |
| 2007/0040326 | A1 | 2/2007 | Noda et al. |
| 2007/0059078 | A1 | 3/2007 | Silverbrook et al. |
| 2007/0138738 | A1 | 6/2007 | Motohashi et al. |
| 2009/0038495 | A1 | 2/2009 | Butzen et al. |
| 2009/0103806 | A1 | 4/2009 | Nakami |
| 2009/0244584 | A1 | 10/2009 | McGarry et al. |
| 2010/0066782 | A1 | 3/2010 | Yamamoto et al. |
| 2010/0169513 | A1 | 7/2010 | Levin |
| 2010/0247222 | A1 | 9/2010 | Bouverie et al. |
| 2010/0319561 | A1 | 12/2010 | Colquitt et al. |
| 2011/0042883 | A1 | 2/2011 | Wang et al. |
| 2011/0132643 | A1 | 6/2011 | Hattori et al. |

OTHER PUBLICATIONS

Written Opinion of the International Searching Authority, PCT/US2012/039043, Aug. 3, 2012.

Written Opinion of the International Searching Authority, PCT/US2012/041093, Aug. 7, 2012.

Written Opinion of the International Searching Authority, PCT/US2012/043734, Sep. 21, 2012.

Written Opinion of the International Searching Authority, PCT/US2012/043709, Sep. 21, 2012.

Written Opinion of the International Searching Authority, PCT/US2012/043772, Sep. 14, 2012.

Written Opinion of the International Searching Authority, PCT/US2012/046712, Oct. 5, 2012.

Written Opinion of the International Searching Authority, PCT/US2012/049417, Nov. 2, 2012.

Written Opinion of the International Searching Authority, PCT/US2012/050938, Nov. 6, 2012.

Written Opinion of the International Searching Authority, PCT/US2012/060956, Jan. 11, 2013.

Written Opinion of the International Searching Authority, PCT/US2012/066291, Feb. 5, 2013.

PRINTING RIBBON SECURITY APPARATUS AND METHOD

CLAIM OF PRIORITY

This application claims priority to U.S. Provisional Patent Application Ser. No. 61/493,598, filed Jun. 6, 2011, entitled Ribbon Security Clean-up, the contents of which are incorporated herein by reference.

FIELD OF INVENTION

The present invention generally relates to printing methods, more specifically, to a printing apparatus and method of providing security to desired information during a printing operation of a thermal transfer printer.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include thermal transfer printers. Typically, a thermal transfer printer is a printer which prints on media by melting a portion of coating of ribbon stream so that it stays attached to the media on which the print is applied. It contrasts with direct thermal printing where no ribbon is present in the process. Typically, thermal transfer printers comprise a supply spindle operable for supplying a media web and ribbon, a print station having a printhead, and a take up spindle. During a printing operation, new ribbon and media is fed from the supply spindle to the print station for printing and then the ribbon is wound up by the take up spindle while the media is exited from the print station.

As the ribbon exits the print station it is rewound on the take up spindle. When printing sensitive information such as, for example, social security numbers, account numbers, and other similar private information, the unused portion of the ribbon will contain a negative image of the subject sensitive information. Undesirably, conventional thermal transfer printing methods provide no means of security to the information which is printed. Because the used ribbon on the take up spindle possesses a negative image of the previously printed image, the secrecy of the information printed on the media may be jeopardized.

It is therefore be desirable to provide a printing system and method which provides security means to information printed on media during a thermal transfer printing operation. It is also be desirable to provide a printing method which allows for the used ribbon of such a thermal transfer printer to be obscured such that the negative image is unable to be read.

SUMMARY OF THE INVENTION

The present invention is designed to overcome the deficiencies and shortcomings of the systems and devices conventionally known and described above. The present invention is designed to reduce the manufacturing costs and the complexity of assembly. In all exemplary embodiments, the present invention is directed to a method of securing and maintaining the integrity of desired information on a ribbon and media subsequent to a printing operation. According to aspects of the present invention, a printer is provided and generally comprises a print station having a printhead, a supply spindle for moving media through the print station and a ribbon drive assembly operable for feeding ribbon along a print path of the printer. In exemplary embodiments, the printhead is capable of being moved or lifted away from the media and ribbon subsequent to a print operation. Further, the ribbon fed through the ribbon drive assembly may be rewound a predetermined distance, thereby allowing for a second print operation on the space previously printed upon. More specifically, the used ribbon can be rewound and utilized to print a random pattern on a piece of waste media (stub) thus obscuring any previous images on the ribbon. In exemplary embodiments, the media can also be reversed a specific distance and reprinted with the used ribbon several times thus obscuring the image on the used ribbon.

If the waste media is printed on only once, the random pattern will reveal what was previously printer due to a lack of wax (ink) on the ribbon. Accordingly, in exemplary embodiments, the method steps are repeated a set number of times thereby eliminating negative images and also reducing the length of waste media required. The ribbon clean-up process can be printed after an original print operation has occurred.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

Figure 5:
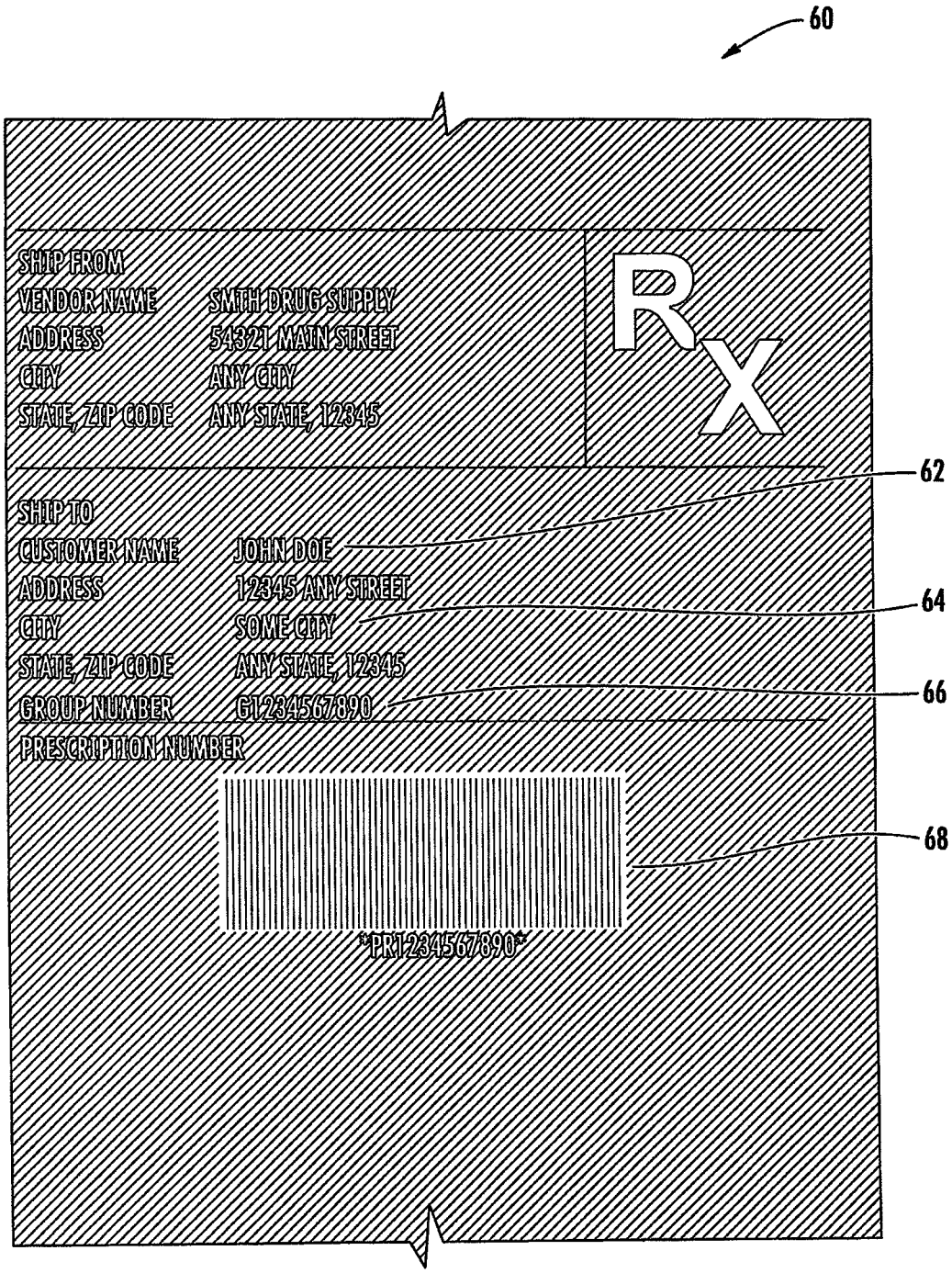
FIG. 5 is a plan view of the negative image remaining on a print ribbon after printing the exemplary printed instrument described in FIG. 4 according to aspects of the present invention.

FIG. **6*a* is a plan view of the negative image remaining on a print ribbon described in FIG. 5** after the security method described herein is utilized employing random characters.

FIG. **6*b* is a plan view of the negative image remaining on a print ribbon described in FIG. 5** after the security method described herein is utilized employing sequential Xs.

DETAILED DESCRIPTION OF THE PREFERRED EMBODIMENT

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

In exemplary embodiments of the present invention, a printing method is provided which overcomes the shortcomings of the prior art by providing a means of security to desired information subsequent to a printing operation. The method includes the provision of a thermal transfer printer (not shown) having a supply spindle operable for supplying a media web (not shown) or ribbon, a print station (not shown) having a printhead (not shown), and a take up spindle. Those skilled in the art will appreciate that many other components may be included within the printer and many configurations may be employed. In all exemplary embodiments, during a printing operation, new or supply ribbon and media is fed from the supply spindle to the print station for printing and then the ribbon is wound up by the take up spindle while the media is exited from the print station. As the ribbon exits the print station it is wound to a take up spindle.

Figure 1:
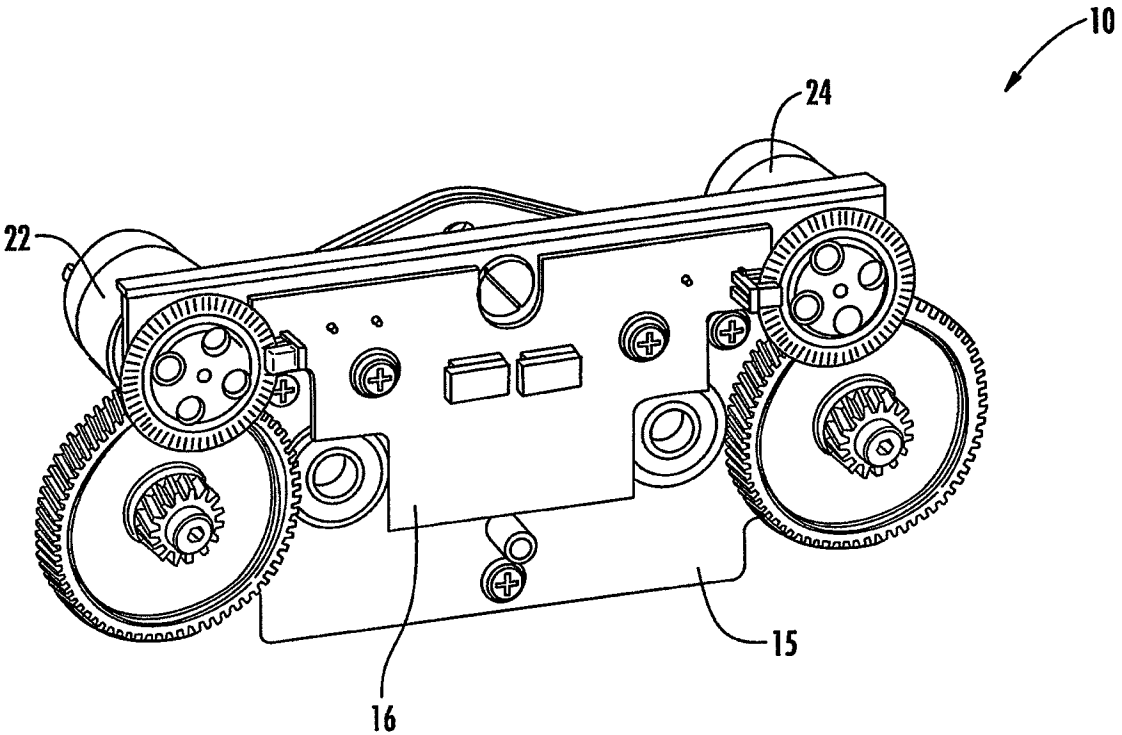
FIG. 1 is a perspective front view of a ribbon drive assembly utilized in the printing operation according to aspects of the present invention.
Figure 3:
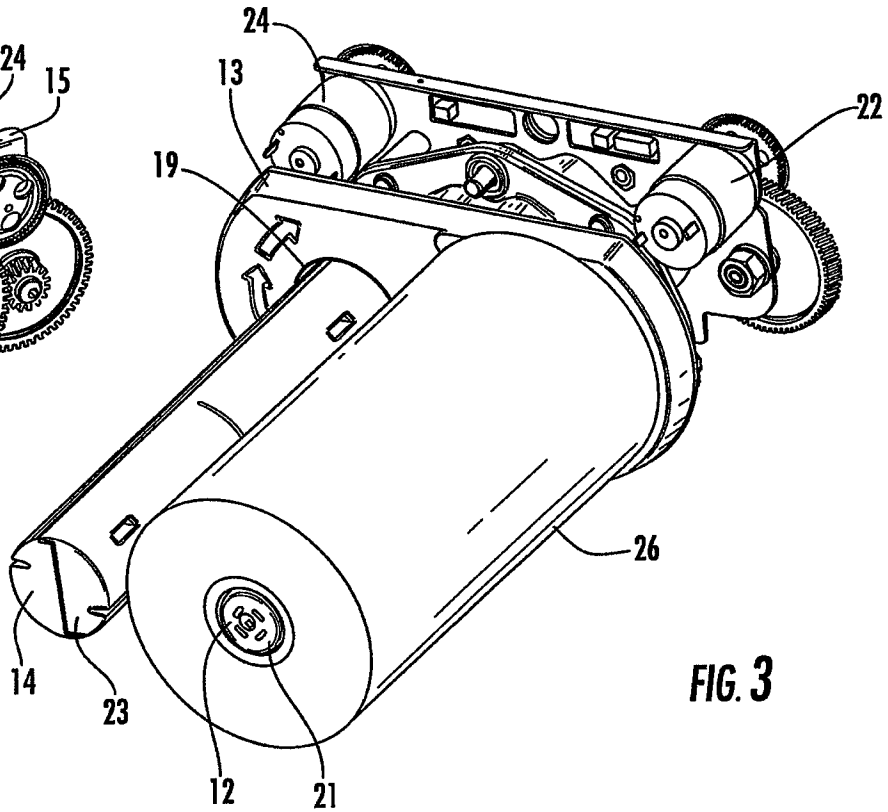
FIG. 3 is a perspective back view of the ribbon drive assembly with a ribbon supply on the supply spindle according to aspects of the present invention.
Figure 2:
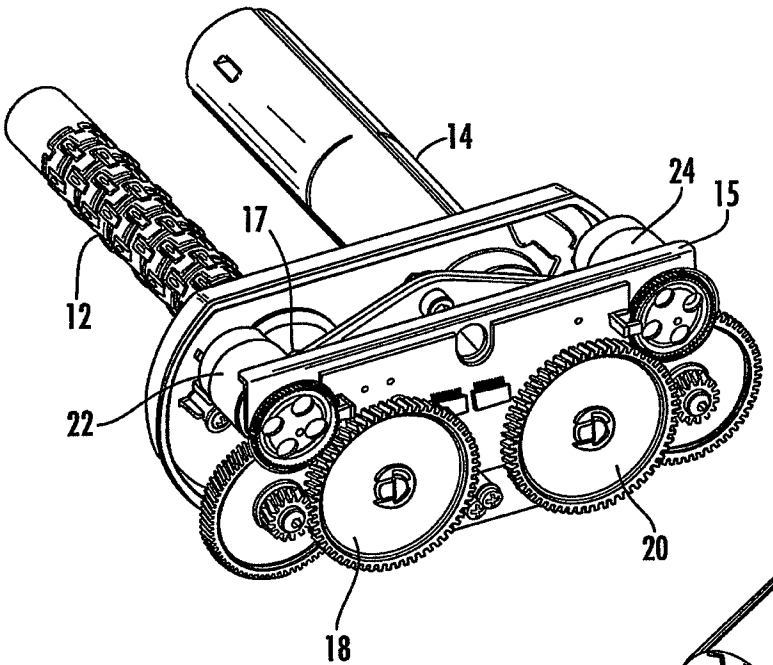
FIG. 2 is a perspective rear view of the embodiment of FIG. 1 according to aspects of the present invention.

Referring now to the drawings and specifically, FIGS. 1-3, a ribbon drive assembly in accordance with exemplary embodiments of the present invention is shown and generally referred to by reference numeral 10. In exemplary embodiments, the ribbon drive assembly 10 assists in the provision of information security by being configured to rewind the ribbon supply a predetermined distance for additional print operations. In a general sense, the ribbon drive assembly 10 controls the feed of the ribbon supply 26 as it unwinds off a supply spindle 12 into a print station (not shown) and then is wound off onto a take-up spindle 14.

In exemplary embodiments, the spindles 12, 14 can be rotatably connected to a base plate 15 at one end and extend through a port 17, 19 of a cover plate 13 such that their respective distal ends 21, 23 are operative for receiving a roll of ribbon supply 26. Each spindle 12, 14 can be provided with an independently operated drive system comprising a plurality of gears 18, 20 for rotating the spindles 12, 14, a motor 22, 24 for driving the plurality of gears 18, 20, respectively, in both a clockwise or counter clockwise direction, and a rotary encoder (not shown). In exemplary embodiments, the drive system can be connected to the base plate 15. It will be understood by those skilled in the art that it is contemplated that the motor 22, 24 will be a DC motor, however, any type of motor suitable for powering the gears 18, 20 and spindles 12, 14 in a rotary movement may be employed. Further, in alternative exemplary embodiments, the motors 22, 24 are independently operated.

The drive assembly 10 can further comprise a circuit board 16 connected to the base plate 15 having a control processor (not shown) for each motor 22, 24 and attached to a side of the base plate 15. The electronics of the circuit board 16 similarly can include two sets of drive components (not shown) for each spindle 12, 14. In exemplary embodiments, the drive assembly 10 can use a processor core (not shown) with programmable digital and/or analog functions and communication components. However, it will be understood by those skilled in the art that a variety of processors may be used. In an exemplary embodiment, the processor (not shown), motor drive IC's (not shown), opto encoders (not shown) and associated circuitry (not shown) can be located on a single board 16 of the drive assembly 10. The processor (not shown) of the drive assembly 10 can be communicatively linked with a main processor of the printer PCB (not shown) via a SPI bus (not shown).

In exemplary embodiments, two independent control systems, one for each motor 22, 24, can be executed every 500 us seconds. By utilizing the independent motor system described above, subsequent to an initial print operation, the ribbon supply 26 may be rewound about the supply spindle 12 for additional print operations. Such print operations may be critical as the used ribbon oftentimes contains a reverse image of what was previously printed.

In exemplary embodiments, subsequent to the initial print operation, the print head (not shown) can be raised or lifted. Thereafter, the used ribbon 26 can be rewound a predetermined distance about the supply spindle 12 and utilized to print a random or block-out pattern on a piece of waste media (stub) thus obscuring any previous images on the ribbon 26. In exemplary embodiments, the media can also be reversed or rewound predetermined distance and reprinted with the used ribbon 26 several times thus further obscuring the image on the used ribbon. The repeated print operations may be desirable because if the waste media is printed on only once, the random pattern will reveal what was previously printer due to a lack of wax (ink) on the ribbon. Printing on the media only once would produce a negative image of the previous image. Reversing the media several times eliminates the negative image and also reduces the length of waste media required.

Figure 4:
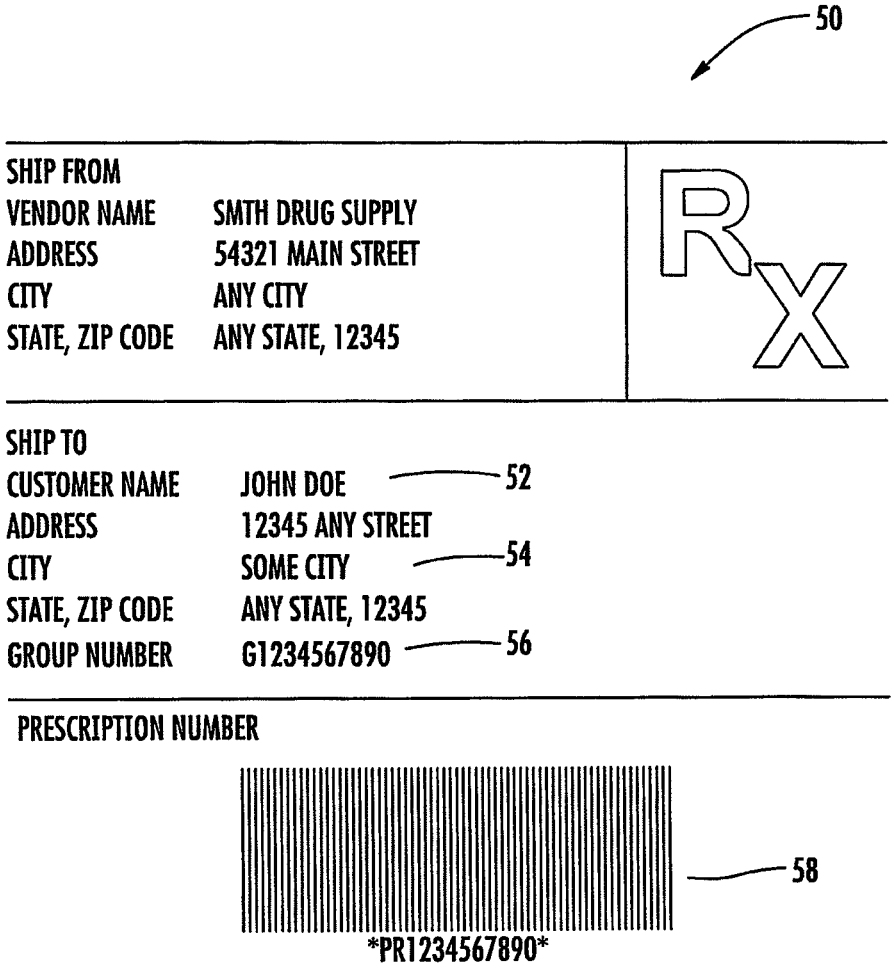
FIG. 4 is a plan view of an exemplary printed instrument containing examples of sensitive information according to aspects of the present invention.

Referring now to FIG. 4, instrument 50 containing exemplary sensitive information is shown. In the exemplary embodiment, sensitive information can include, for example: a name 52; an address 54; an account number 56; and/or a prescription 58. As will be appreciated by one skilled in the art, these examples are not limiting as it may be desired to protect additional forms of sensitive information.

Turning next to FIG. 5, a drawing of a used printing ribbon 60 is shown. For purposes of illustration, the used printing ribbon 60 shown in FIG. 5 represents the used printing ribbon that would result from creating the instrument 50 depicted in FIG. 4 prior to the application of the method described herein. As is shown, the used printing ribbon 60 comprises a negative image of the sensitive information contained on the instrument 50, such as, for example: a name 62; an address 64; an account number 66; and a prescription number 68.

Figure 6B:
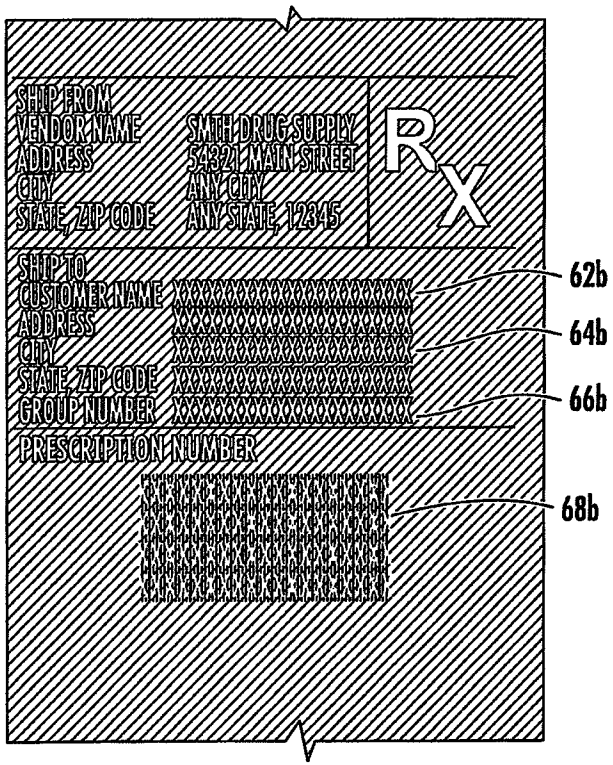
Figure 6A:
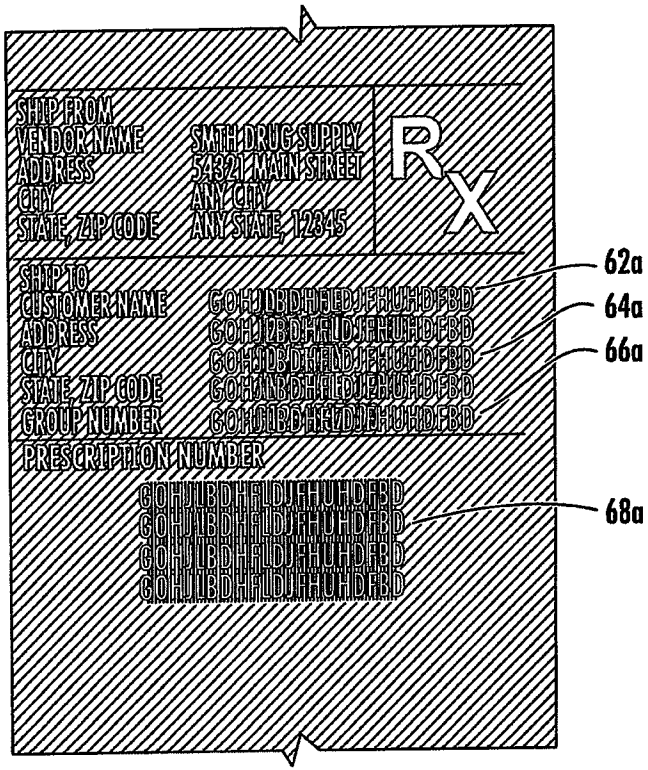

Finally turning to FIGS. 6*a* and 6*b*, drawings of used printing ribbons 60*a* and 60*b* are shown after the application of the method described herein. The used printing ribbon 60*a* contains information that is obscured by random characters. The used printing ribbon 60*b* contains information that is obscured by sequential Xs, i.e., an X-out pattern. The information obscured in FIGS. 6*a* and 6*b* includes, for example, names 62*a*, 62*b*, addresses 64*a*, 64*b*, account numbers 66*a*, 66*b*, and prescription numbers 68*a* and 68*b*. Alternative embodiments contemplate that other designs (not shown) and/or block-out printing (not shown) may be employed to obscure any sensitive information on the printer ribbon 60 and render it unreadable or eliminate the sensitive information from the printer ribbon 60 altogether.

Aspects according to the present invention contemplate that sensitive information will come is a plethora of forms. For exemplary purposes, such sensitive information can include: names, amounts, account numbers, addresses, memo entries, social security numbers, FEINs, ID numbers, medical information, financial information, passport numbers, draft numbers, document numbers; PINs, alphanumeric codes and any other similar information desired to be protected.

The embodiments described above provide advantages over conventional devices and associated methods of manufacture. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Furthermore, the foregoing description of the preferred embodiment of the invention and best mode for practicing the invention are provided for the purpose of illustration only and not for the purpose of limitation—the invention being defined by the claims.

What is claimed is:

1. A ribbon printing security apparatus comprising:

a printer having a print station, a ribbon drive assembly and a media feed supply, wherein said media feed supply feeds media through the print station and under a printhead;

wherein the ribbon drive assembly feeds a print ribbon from a supply spindle to the printhead and wherein a first print operation is performed by printing a desired image on the media;

wherein the newly printed media is exited from the print station;

wherein the directional path of the ribbon supply feed is reversed a specific distance whereby the ribbon supply is temporarily rewound about the supply spindle of the ribbon drive assembly;

and wherein a second print operation is performed by printing through the ribbon at a desired location on the ribbon thereby obscuring at least a portion of an image remaining on the ribbon from the first print operation.

2. The apparatus of claim 1 wherein said print ribbon comprises thermal print ribbon.

3. The apparatus of claim 2 wherein printing through said ribbon comprises printing characters or patterns through the desired location on said ribbon.

4. The apparatus of claim 2 wherein printing through said ribbon comprises printing a block-out pattern through the desired location on said ribbon.

5. The apparatus of claim 2 wherein printing through said ribbon comprises printing through said ribbon onto waste media.

6. The apparatus of claim 2 wherein printing through said ribbon comprises printing through said ribbon at least twice.

7. The apparatus of claim 2 further comprising a take-up spindle onto which used printer ribbon is wound after a second or any subsequent print operations.

8. The apparatus of claim 7, wherein said supply spindle and said take-up spindle is each driven by an independent motor.

9. The apparatus of claim 8 wherein said supply spindle motor and said take-up motor are both DC motors.

10. The apparatus of claim 2 wherein printing through the ribbon at a desired location prints through one or more types of sensitive information selected from the group consisting of: a name; an amount; an account number; an address; a memo entry; a social security number; a FEIN; an ID number; medical information; financial information; a passport number; a draft number; a document number; a PIN; and an alphanumeric code.

11. A method of printing comprising the steps of:

providing a printer having a print station, a ribbon drive assembly and a media feed supply;

feeding a ribbon supply and media through the print station and under a printhead, wherein the ribbon drive assembly feeds a print ribbon from a supply spindle to the printhead;

performing a first print operation by printing a desired image on the media; exiting the newly printed media from the print station;

reversing the directional path of the ribbon supply feed a specific distance and temporarily rewinding the ribbon supply about the supply spindle of the ribbon drive assembly; and performing a second print operation by printing through the ribbon at a desired location on the ribbon and onto a waste media, thereby obscuring at least a portion of an image remaining on the ribbon from the first print operation.

12. The method of claim 11 wherein said print ribbon comprises thermal print ribbon.

13. The method of claim 12 wherein printing through said ribbon comprises printing a random pattern through the desired location on said ribbon.

14. The method of claim 12 wherein printing through said ribbon comprises printing a block-out pattern through the desired location on said ribbon.

15. The method of claim 12 wherein printing through said ribbon comprises printing through said ribbon at least twice.

16. The method of claim 12 further comprising winding used printer ribbon onto a take-up spindle after a second or any subsequent print operation.

17. The method of claim 16, further comprising driving each said supply spindle and said take-up spindle by an independent motor.

18. The method of claim 17 wherein said supply spindle motor and said take-up motor are both DC motors.

19. The method of claim 11 wherein printing through the ribbon at a desired location includes printing through one or more types of sensitive information selected from the group consisting of: name; an amount; an account number; an address; a memo entry; a social security number; a FEIN; an ID number; medical information; financial information; a passport number; a draft number; a document number; a PIN; and an alphanumeric code.

20. A printing ribbon security method for printing on thermal printing media comprising the steps of:

providing a printer having a print station, a ribbon drive assembly and a media feed supply;

feeding a ribbon supply and media through the print station and under a printhead, wherein the ribbon drive assembly feeds a print ribbon from a supply spindle to the printhead;

performing a first print operation by printing a desired image on the media with the printhead; exiting the newly printed media from the print station;

reversing the directional path of the ribbon supply feed a specific distance and temporarily rewinding the ribbon supply about the supply spindle of the ribbon drive assembly;

performing a second print operation by printing through the ribbon at a desired location on the ribbon and onto a waste media at least one time, thereby obscuring at least a portion of an image remaining on the ribbon from the first print operation; and winding the ribbon onto a take-up spindle after performing the second print operation.

* * * * *